US010283876B1

(12) United States Patent
Livadaru et al.

(10) Patent No.: US 10,283,876 B1
(45) Date of Patent: May 7, 2019

(54) DUAL-POLARIZED, PLANAR SLOT-APERTURE ANTENNA ELEMENT

(71) Applicant: Rockwell Collins, Inc., Cedar Rapids, IA (US)

(72) Inventors: Matilda G. Livadaru, Marion, IA (US); Jeremiah D. Wolf, Marion, IA (US); Christopher Olson, Cedar Rapids, IA (US); Lee M. Paulsen, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 501 days.

(21) Appl. No.: 15/222,192

(22) Filed: Jul. 28, 2016

(51) Int. Cl.

| | |
|---|---|
| ***H01Q 21/08*** | (2006.01) |
| ***H01Q 21/24*** | (2006.01) |
| ***H01Q 15/24*** | (2006.01) |
| ***H01Q 1/48*** | (2006.01) |
| ***H01Q 15/00*** | (2006.01) |

(52) U.S. Cl.
CPC ..... *H01Q 21/245* (2013.01); *H01Q 1/48* (2013.01); *H01Q 15/0086* (2013.01); *H01Q 15/24* (2013.01)

(58) Field of Classification Search
CPC .. H01Q 21/065; H01Q 1/243; H01Q 21/0075; H01Q 21/20; H01Q 21/24; H01Q 21/08; H01Q 21/245; H01Q 15/0086; H01Q 15/24
See application file for complete search history.

(56) References Cited

U.S. PATENT DOCUMENTS

| | | | | |
|---|---|---|---|---|
| 4,684,953 | A * | 8/1987 | Hall | H01Q 9/38 343/725 |
| 7,940,228 | B1 * | 5/2011 | Buckley | H01Q 15/0086 343/700 MS |
| 8,217,846 | B1 * | 7/2012 | Buckley | H01Q 1/00 343/730 |
| 8,872,713 | B1 * | 10/2014 | Buckley | H01Q 1/405 343/767 |
| 2010/0238072 | A1 * | 9/2010 | Ayatollahi | H01Q 1/243 343/700 MS |
| 2012/0306698 | A1 * | 12/2012 | Warnick | H01Q 5/35 342/372 |

* cited by examiner

*Primary Examiner* — Tho G Phan
(74) *Attorney, Agent, or Firm* — Angel N. Gerdzhikov; Donna P. Suchy; Daniel M. Barbieri

(57) ABSTRACT

An electronically scanned array (ESA) is configured for a high-degree of isolation between adjacent radiating elements and between co-located ports. Radiating elements of the ESA include a centrally located slot-aperture configured as a radiating source, and multiple via-apertures positioned around and between each port of the co-located ports. An amount of metamaterial structures found in a unit cell of an antenna layer ascendingly increases from a bottom antenna layer to a top antenna layer, with groups of metamaterial structures differing in orientation with respect to unit cells of two or more antenna layers and with respect to two groups found within a unit cell of the top antenna layer.

19 Claims, 15 Drawing Sheets

$\theta=[0-60]^0$, $\phi=[0,45,90]^0$

DUAL-POLARIZED, PLANAR SLOT-APERTURE ANTENNA ELEMENT

The present application is related to U.S. Pat. No. 9,356,360, entitled DUAL POLARIZED PROBE COUPLED RADIATIG ELEMENT, naming Michael J. Buckley, Jeremiah D. Wolf, Matilda G. Livadaru, and Christopher G. Olson as inventors, filed Oct. 2, 2014, which is incorporated herein by reference to the extent such subject matter is not inconsistent herewith.

BACKGROUND

Antennas include transducers designed to transmit or receive electromagnetic waves. Antennas may convert electromagnetic waves into electrical currents and electrical currents into electromagnetic waves. Antennas often utilize radiating elements capable of transmitting and/or receiving electromagnetic energy.

Phased array antennas provide rapid electronic radiation beam scanning as required by advanced communications, data link, radar and SATCOM systems. The ability to rapidly scan the radiation pattern of a phased array antenna may allow for multifunction/multi-beam/multi-target, LPI/LPD (low probability of intercept and low probability of detection) and A/J (anti-jam) capabilities. Polarization matched satellite tracking and broad band, multi-function phased array architectures may also enable simultaneous reception of satellite TV and other data links.

Existing antennas are often bulky, mechanically steered arrays. When attached to a platform such as a vehicle or airplane, these bulky antennas often fail to meet stringent form factors. Further, performance requirements placed on SATCOM electronically scanned arrays (ESA), are not met by existing technologies. For example, current planar radiating element technology is usually one-dimensional and is not readily available for use in Ku-Band SATCOM. By way of another example, current planar radiating element technology does not effectively meet isolation requirements between radiating elements.

Further, existing directional couplers often require full direct current (DC) connections. When implemented as transmission line couplers, these full DC connections require additional time and material to form the structures (e.g., striplines) in order to provide the DC coupling.

Therefore, it is desirous to obtain more robust, secure and otherwise improved ESA technologies, methods, and apparatuses that are more versatile in communication capabilities and contribute to reduced size, weight and power (SWAP) constraints.

SUMMARY

In one aspect, the inventive concepts disclosed herein are directed to an electrically scanned array (ESA) system. In a further aspect, the ESA system includes a two or more dimensional radiating element that includes a plurality of metamaterial structures. In a further aspect, the ESA system includes a ground plane having two or more ports configured for slot-aperture coupling to electrically couple a stripline feed and a radio frequency (RF) source with the two or more dimensional radiating elements. In a further aspect, the two or more ports are surrounded, around and between, with a plurality of grounded vias.

In another aspect, the inventive concepts disclosed herein are directed to an antenna. In a further aspect, the antenna includes an array of radiating elements comprising a plurality of metamaterial structures formed in a substrate material. In a further aspect the antenna includes a ground plane having one or more slot-apertures formed therein, the one or more slot-apertures comprising a plurality of ports, the plurality of ports including a first port with a first polarization and a second port with a second polarization. In a further aspect, electromagnetic energy radiated from a stripline feed couples the one or more slot-apertures with the array of radiating elements.

In another aspect, the inventive concepts disclosed herein are directed to an electronically scanned array (ESA) radiating element. In a further aspect, the radiating element includes a radio frequency (RF) source. In a further aspect, the radiating element includes a stripline feed. In a further aspect, the radiating element includes a ground plane layer having a slot-aperture formed therein. In a further aspect, the radiating element includes a plurality of metamaterial layers, wherein electromagnetic energy radiating from the stripline feed couples the plurality of metamaterial layers with the RF source.

BRIEF DESCRIPTION OF THE DRAWINGS

Implementations of the inventive concepts disclosed herein may be better understood when consideration is given to the following detailed description thereof. Such description makes reference to the included drawings, which are not necessarily to scale, and in which some features may be exaggerated and some features may be omitted or may be represented schematically in the interest of clarity. Like reference numerals in the drawings may represent and refer to the same or similar element, feature, or function. In the drawings.

DETAILED DESCRIPTION OF EXEMPLARY EMBODIMENTS

Figure 1:
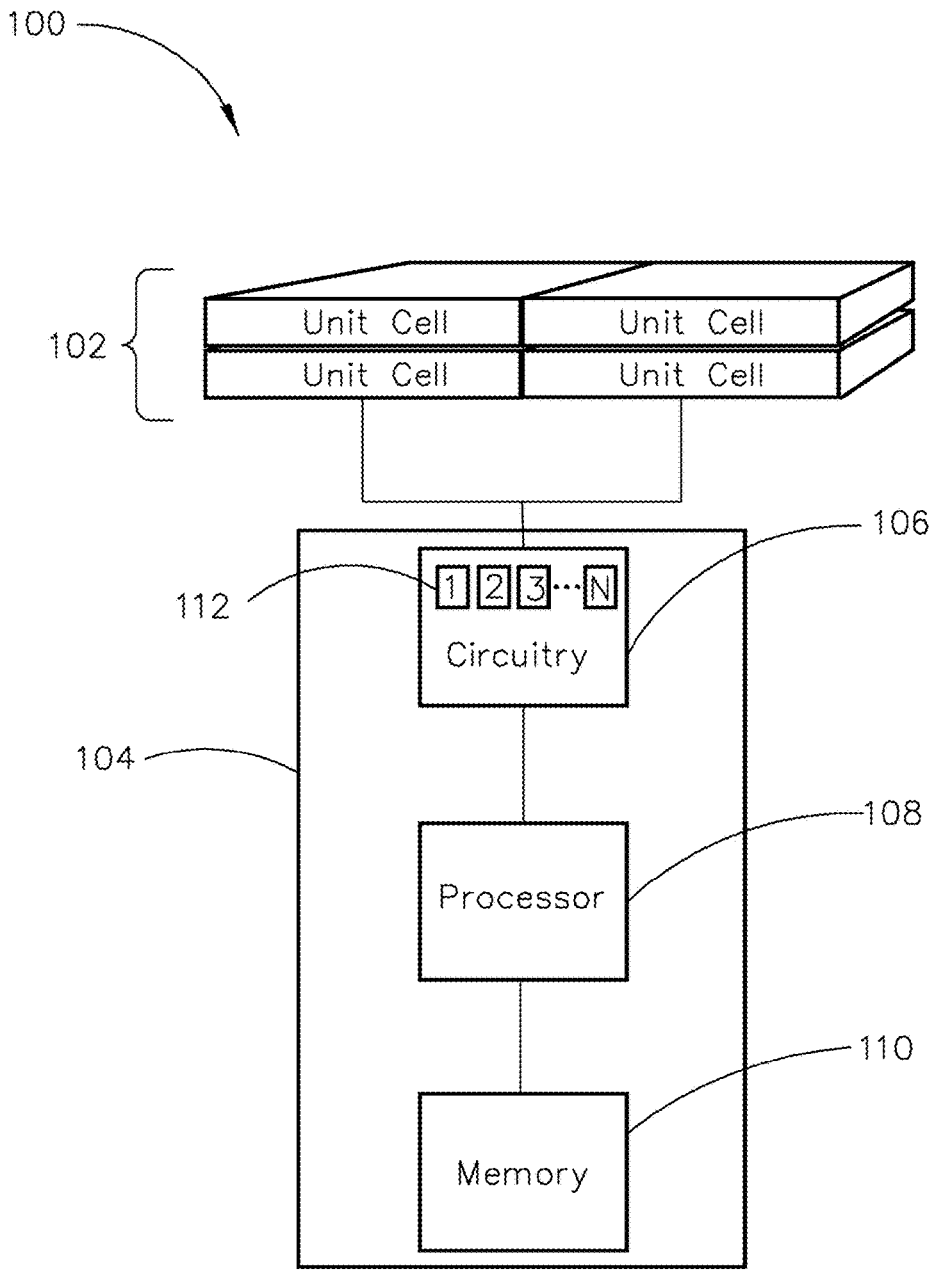
FIG. 1 shows a block diagram of a radiating element, circuitry, processor, and memory, according to the inventive concepts disclosed herein.

Before explaining at least one embodiment of the inventive concepts disclosed herein in detail, it is to be understood that the inventive concepts are not limited in their application to the details of construction and the arrangement of the components or steps or methodologies set forth in the following description or illustrated in the drawings. In the following detailed description of embodiments of the instant inventive concepts, numerous specific details are set forth in order to provide a more thorough understanding of the inventive concepts. However, it will be apparent to one of ordinary skill in the art having the benefit of the instant disclosure that the inventive concepts disclosed herein may be practiced without these specific details. In other instances, well-known features may not be described in detail to avoid unnecessarily complicating the instant disclosure. The inventive concepts disclosed herein are capable of other embodiments or of being practiced or carried out in various ways. Also, it is to be understood that the phraseology and terminology employed herein is for the purpose of description and should not be regarded as limiting.

As used herein a letter following a reference numeral is intended to reference an embodiment of the feature or element that may be similar, but not necessarily identical, to a previously described element or feature bearing the same reference numeral (e.g., 1, 1*a*, 1*b*). Such shorthand notations are used for purposes of convenience only, and should not be construed to limit the inventive concepts disclosed herein in any way unless expressly stated to the contrary.

Further, unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of embodiments of the instant inventive concepts. This is done merely for convenience and to give a general sense of the inventive concepts, and "a" and "an" are intended to include one or at least one and the singular also includes the plural unless it is obvious that it is meant otherwise.

Finally, as used herein any reference to "one embodiment," or "some embodiments" means that a particular element, feature, structure, or characteristic described in connection with the embodiment is included in at least one embodiment of the inventive concepts disclosed herein. The appearances of the phrase "in some embodiments" in various places in the specification are not necessarily all referring to the same embodiment, and embodiments of the inventive concepts disclosed may include one or more of the features expressly described or inherently present herein, or any combination of sub-combination of two or more such features, along with any other features which may not necessarily be expressly described or inherently present in the instant disclosure.

"Dual polarization" as used herein means left-handed circular (LHC), right-handed circular (RHC), and dual-linear polarization.

"Metamaterial" as used herein means material designed to have magnetic or electric resonances. Generally, a metamaterial is formed in a substrate and may have structural features smaller than the wavelength of the electromagnetic radiation with which it interacts. Additionally, metamaterials may include artificial materials constructed into arrays of current-conducting (e.g., radiating) elements with suitable inductive and capacitive characteristics.

"Metamaterial structure" as used herein means a structure, shape, inclusion, or conductive strip of metamaterial formed, embedded in, positioned on, suspended in, or otherwise positioned on a substrate using means known in the art (e.g., standard printed circuit board (PCB) processes). The metamaterial structure may include a dipole structure, a Higher-Order Floquet (HOF) scattering member, symmetrical structures, asymmetrical structures, electrically-large impedance-matching structures, electrically-small impedance-matching structures, or combinations thereof.

"Unit cell" as used herein means a group of metamaterial structures of an antenna layer.

"Radiating element" as used herein means one or more unit cells. A one-dimensional (1-D) radiating element is analogous to a single unit cell; a two-dimensional radiating element is analogous to a first unit cell with a second unit cell stacked (e.g., vertically arranged) on top of the first unit cell; a three-dimensional radiating element is three unit cells stacked on top of each other; and so on. Thus, in some embodiments, "radiating element" is used interchangeably with the term "unit cell".

"Receive array" or "transmit array" as used herein means an array of adjacent (e.g., vertically and/or horizontally adjacent) antenna unit cells electronically fed respectively to function as either a transmit antenna array or a receive antenna array.

"Antenna layer" as used herein means a planar metallization or metamaterial layer including multiple (e.g., two or more) antenna unit cells.

"Aperture" as used herein means a portion of a ground plane surface very near an antenna radiating element, that is cut-out or formed in the portion of the ground plane to provide a space normal to the direction of maximum radiant intensity, through which a major part of the antenna radiation passes.

"Phased array" as used herein means an antenna that is a beam forming antenna in which the relative phases of the respective signals feeding the antennas are varied such that the effective radiation pattern of the phased array is reinforced in a desired direction and suppressed in undesired directions. The relative amplitudes of constructive and destructive interference effects among the signals radiated by the individual antennas determine the effective radiation pattern of the phased array. A phased array may be used to rapidly electronically scan in azimuth or elevation.

"Electrically scanned array" (ESA) as used herein means a type of phased array antenna including numerous unit cells for both transmit and receive capabilities. The term ESA encompasses an active electrically scanned antenna (AESA) and a passive electronically scanned antenna (PESA). The AESA utilizes multiple solid-state transmit-receive modules (TRMs) and constructive interference of signals that are separately and individually emitted from each unit cell to perform beamforming. The PESA utilizes a single central radio frequency source and multiple phase shift modules that send energy to unit cells to perform beamforming.

"Fractional bandwidth" as used herein means $FBW=f_2-f_1/f_c$, or FBW=100*(f_high−f_low)/f_center, where f_low=lowest frequency of operation, f_high=highest frequency of operation, and f_center=f_low+0.5*(f_high−f_low).

"Higher-Order Floquet (HOF) scattering member" as used herein means an electrically-small metamaterial structure having any desired shape, including but not limited to, square, triangular, L-shaped, M-shaped, irregular, or combinations thereof.

"Dipole" as used herein means an electrically-large, elongated (e.g., rectangular or strip) metamaterial structure. In some embodiments, the dipole is implemented as an impedance matching dipole.

"Electrically-small" as used herein means a metamaterial structure with conductive properties and smaller in size, length, width, or diameter than an operational wavelength or spectrum for which a respective radiating element in which the structure is implemented is configured to operate.

"Electrically-large" as used herein means a metamaterial structure with conductive properties and of a size greater than or equal to about 0.25 of the wavelength or spectrum for which a respective radiating element in which the structure is implemented is configured to operate.

"FR-4" as used herein is a general term encompassing digital, printed circuit board (PCB) material. The "FR" stands for Flame Retardant and "4" generally means a woven glass reinforced epoxy resin.

Broadly, the inventive concepts disclosed herein are directed to dual polarized strip-fed, slot-aperture radiating elements. The slot-aperture coupling of the radiating elements may provide a high-degree of isolation over scan (e.g., multiple look angles) for multiple polarizations.

In some embodiments, the dual polarized, aperture-coupled radiating elements are planar-phased array antenna elements having moderate bandwidth, wide scanning capability (e.g., up to 60 degrees from boresite), and ease of manufacturability using standard PCB processes with FR-4 materials. The radiating elements are tileable in multiple directions (e.g., vertically or along the z-axis, and horizontally or along the x-axis and y-axis). The radiating elements include a specific type of aperture slot coupling for high isolation and wide scan volume. The radiating elements are configured to maximize impedance matching without introducing additional noise and/or additional modes. The radiating elements are directionally coupled using only partial direct DC connections, and primarily relying on AC coupling.

In some embodiments, the radiating elements are implemented in antenna systems for satellite communication applications (e.g., for one or both of a low-earth orbit (LEO) satellite and a geostationary orbit (GEO satellite communication). In some embodiments, the antenna systems are configured for one or more bands of satellite communication (e.g., SATCOM Ka or Ku band). In some embodiments, the antenna systems include a small form factor, low fabrication cost, and high performance ESA.

Referring now to FIG. 1, a block diagram of an antenna system 100, according to the inventive concepts disclosed herein is shown implementing an array of radiating elements 102, the array of radiating elements 102 may be coupled to an interconnecting assembly 104. In an exemplary embodiment, the interconnecting assembly 104 may include radiating element circuitry 106, a processor 108, and memory 110. In an exemplary embodiment, the array 102 is a two or more dimensional array.

In an exemplary embodiment, the radiating element circuitry 106 may be configured to utilize the processor 108 to adjust an RF phase output at different power levels according to one or more algorithms and/or instructions, which may be stored in the memory 110. In another exemplary embodiment, the radiating element circuitry 106 may be configured to utilize the processor 108 to send phase shifting and/or amplifier control signals between radiating elements of the array 102. For example, the radiating element circuitry 106 may be configured to provide the proper RF signals, control signals, bias and chassis ground to each individual radiating element and phase shifter of the array 102. One or more phase shifting devices 112 may be implemented by the circuitry 106. For example, a phase shifter, a true time delay (TTD) device or a T/R (transmit/receive) module with an integrated phase shifter may be used to phase shift and beam steer a radiated beam of the antenna system 100. Control signals may be provided to each phase shifter device 112 from, for example, the processor 108 (e.g., beam steering computer) and bias voltages may be provided to each phase shifter device 112 from an appropriate power source (not shown).

Figure 2:
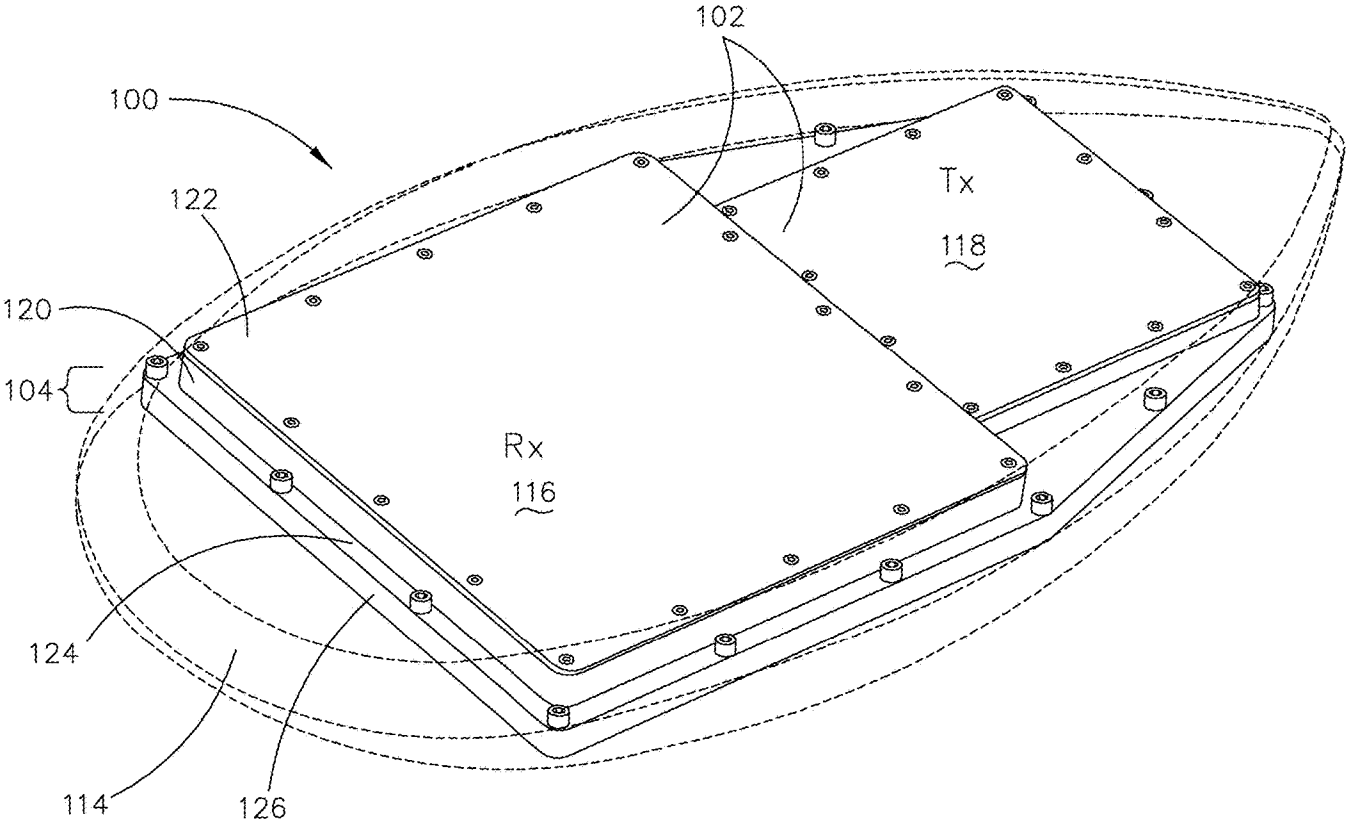
FIG. 2 is an exemplary embodiment of an antenna system and radome, according to the inventive concepts disclosed herein.

Referring now to FIG. 2, a perspective diagram of an embodiment of the antenna system 100 is shown implemented under a protective radome layer 114. In an exemplary embodiment, the antenna system 100 is an ESA configured to operate in at least one of the Ku and Ka bands. Below the protective radome layer 114, the ESA 100 includes the array of radiating elements 102 (e.g., receive array 116 and/or transmit array 118).

In an exemplary embodiment, the array of radiating elements 102 includes multiple layers 120. For example, each respective array 116 and/or 118 may include two or more antenna layers 120. In an exemplary embodiment, the array of radiating elements 102 includes a protective/encapsulating layer 122. For example, the protective/encapsulating layer 122 may be formed from a layer of FR-4 applied at the end of the manufacturing process to protect the underlying metal layers). In an exemplary embodiment, the multiple antenna layers 120 are positioned on top of the interconnecting assembly 104.

In an exemplary embodiment, the interconnecting assembly 104 includes multiple layers. For example, the interconnecting assembly 104 may include a ground plane 124 (e.g., conductive/metallization distributor) and a manifold/feed layer 126 (e.g., including a feed substrate).

In an exemplary embodiment, the radome layer 114 may be constructed of fiberglass, PTFE-coated fabric, a layer of standard epoxy (e.g., FR-4) material, or combinations thereof. In an exemplary embodiment, underlying layers are balanced so as to reduce or eliminate warping or "potato chipping," as the material for the radome layer 114 is applied. In an exemplary embodiment, the antenna system 100, including radome layer 114, is attached to a vehicle.

Figure 3:
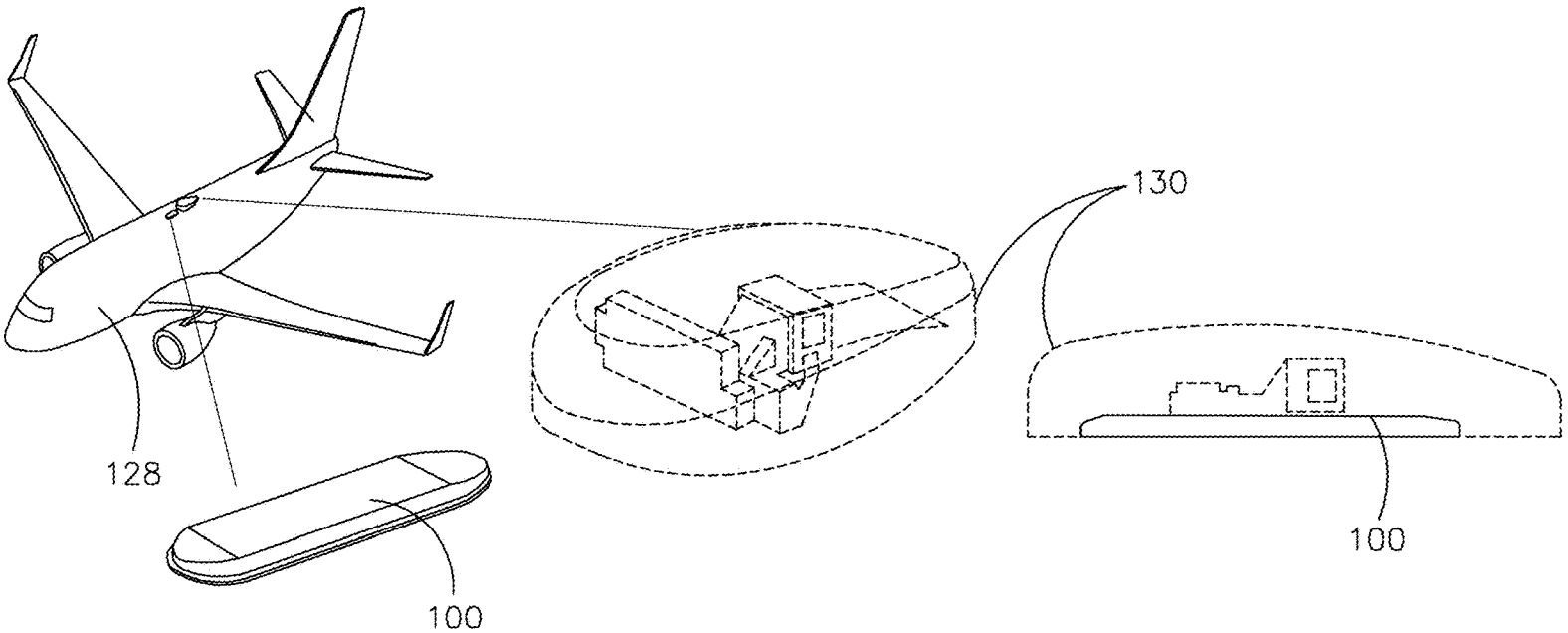
FIG. 3 is an exemplary embodiment of an ESA antenna system as compared to a mechanically steered array, according to the inventive concepts disclosed herein.

Referring now to FIG. 3, an embodiment of the antenna system 100 is depicted as attached to an aircraft 128. It is noted that while embodiments of the present disclosure depict the antenna system 100 as attached to a commercial airliner, this specific depiction is not limiting. For example, the antenna system 100 may be attached to a spaced-based vehicle (e.g., shuttle), a ship, a ground-based vehicle, an Unmanned Aerial Vehicle (UAV), a commercial airliner (e.g., Boeing 747-400, Airbus, MD-80, etc.), a military aircraft, or combinations thereof. Also depicted in FIG. 3 is an embodiment of a mechanically steered ESA 130. The mechanically steered ESA 130 depicted next to the antenna system 100 helps illustrate the better form factor obtainable by the ESA 100 as compared to current mechanically steered ESAs (e.g., 130). In an exemplary embodiment, advantages of the inventive concepts disclosed herein, including but not limited to, the better form factor obtained, may be attributed to a number of features of the inventive concepts of the present disclosure. For example, the advantages may be attributed to the slot-aperture coupling, elements that are tileable in multiple directions, a no moving parts planar approach for the array of radiating elements 102, and individual radiating elements with multiple (e.g., dual) polarization capabilities.

Figure 4:
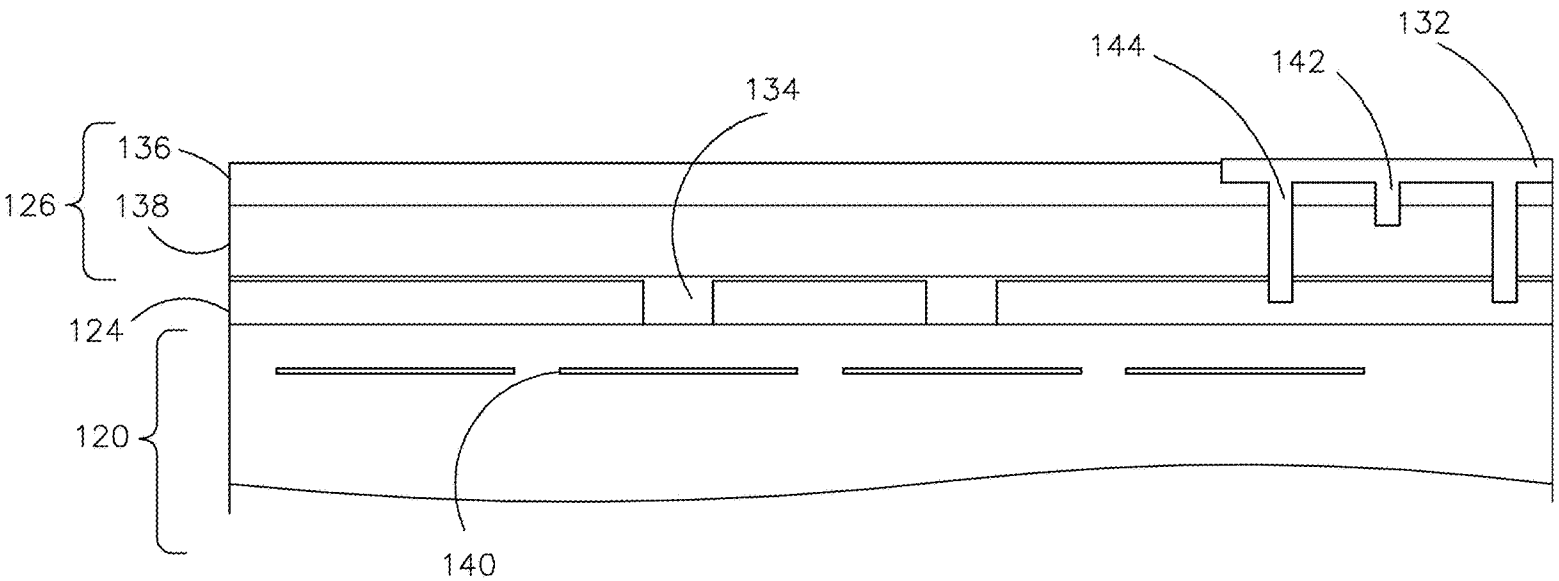
FIG. 4 shows a cross-sectional side view of a radiating element, according to the inventive concepts disclosed herein.

Referring now to FIG. 4, in an exemplary embodiment the array of radiating elements 102 may include the ground plane 124, the manifold/feed layer 126, and an RF source 132 to provide RF signals to the antenna system 100. The ground plane 124 may include one or more slot-apertures 134 to provide an alternating current (AC) electrical connection with the manifold/feed layer 126. In an exemplary embodiment, the one or more slot-apertures 134 may form a directional coupler. In another exemplary embodiment, the antenna system 100 includes a Lange coupler or a hybrid coupler (not shown) implemented off of, or underneath the backside of, the PCB board.

In an exemplary embodiment, the manifold/feed layer 126 may include a feed substrate layer 136 and a manifold layer 138. The multiple antenna layers 120 may include multiple metamaterial structures 140 suspended in substrate in multiple parallel planes (e.g., forming the multiple antenna layers 120) to receive, absorb, and/or emit radiated electromagnetic energy. The metamaterial structure 140 may be formed using any suitable metal and/or conductive material, including but not limited to, aluminum, copper, metal alloy, or combinations thereof.

In an exemplary embodiment, the RF source 132 is electrically connected to one or more vias. For example, the RF source 132 may be have a DC connection with a signal via 142 (e.g., cylindrical via, square via, rectangular via, or combinations thereof). By way of another example, the RF source may have an electrical connection with a ground via 144. The signal via 142 is configured to provide one or more RF signals to the antenna system 100 and will not have an electrical connection with the ground plane 124. The signal via 142 may be formed on the back side of the PCB (e.g., back-drilled). In an exemplary embodiment, the signal via 142 is filled with conductive material (e.g., copper, aluminum, or combinations thereof). In another exemplary embodiment, the signal via 142 includes only a thin coating of conductive material (e.g., electroplated copper) and the remainder of the signal via 142 is filled with an insulator or a dielectric material in order to save on cost. The ground via 144 has an electric connection with the ground plane 124 and may be utilized to maximize radiating element isolation and/or co-located port isolation. For example, the ground via 144 may insulate adjacent radiating elements from radiation emanating from the radiating element in which the ground via 144 is formed. By way of another example, the ground via 144 may insulate respective co-located ports from radiation emanating from each other.

It is noted that although embodiments may depict the signal via 142 or the ground via 144 without pads, this depiction is only for illustrative purposes, as pads may be added during fabrication. In an exemplary embodiment, the pads are added to a substrate layer that is between the ground plane 124 and the manifold/feed layer 126 (e.g., pads are on the board-side of the antenna).

Figure 5:
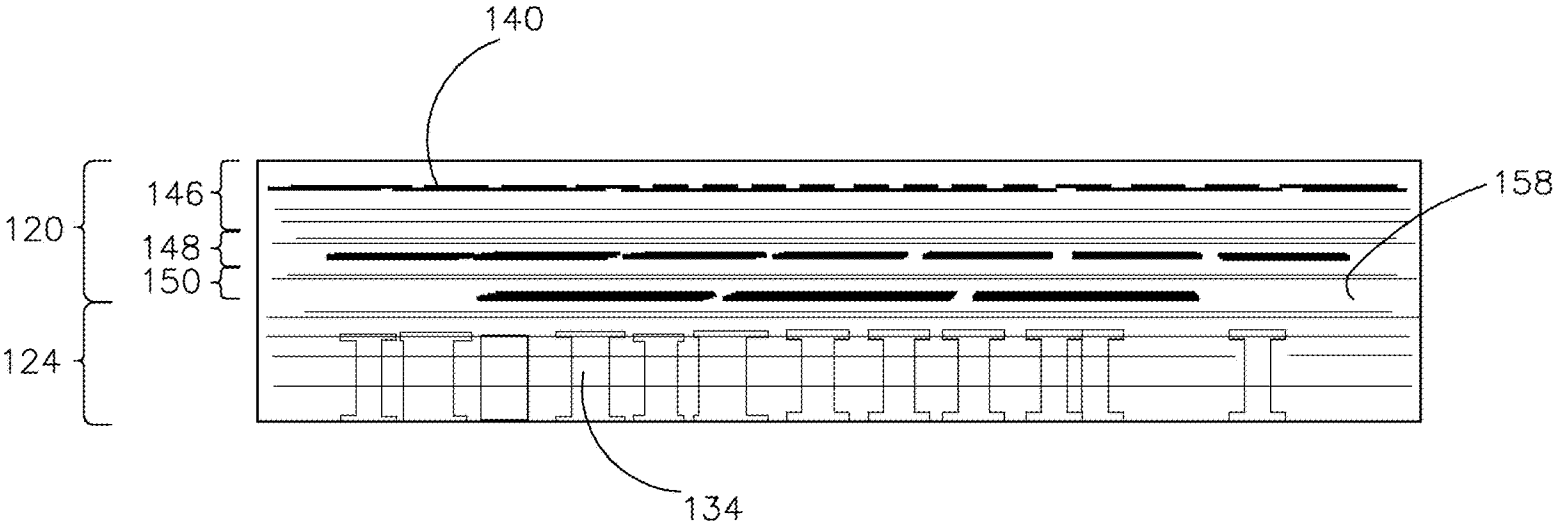
FIG. 5 shows a cross-sectional side view of a radiating element, according to the inventive concepts disclosed herein.
Figure 6:
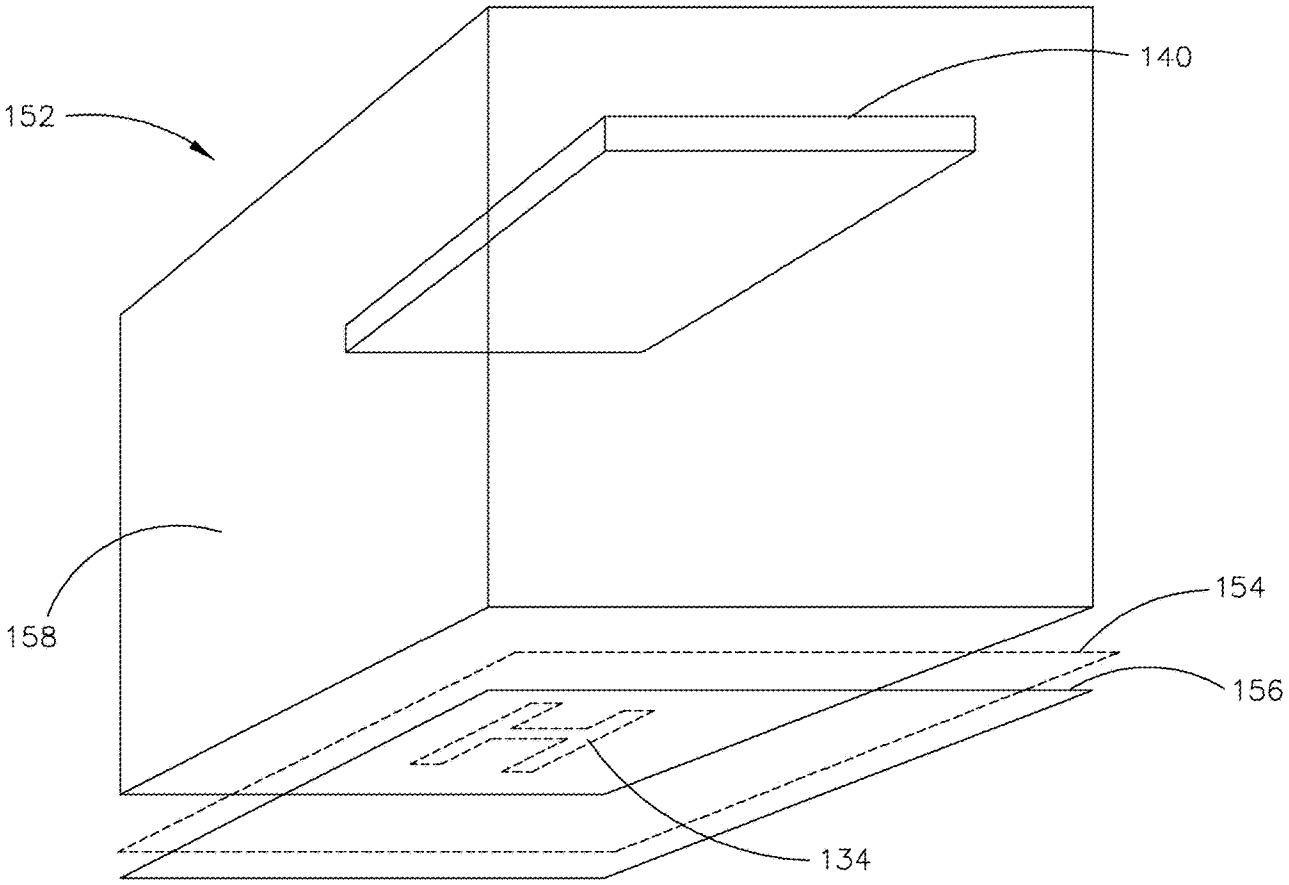
FIG. 6 is a partial isometric view illustrating a portion of an antenna layer using slot-aperture coupling, a portion of a ground plane layer, and a portion of a feed/manifold layer, according to the inventive concepts disclosed herein.

Referring now to FIGS. 5 and 6, an exemplary embodiment of the multiple antenna layers 120 of the array 102 includes three parallel antenna layers including a top antenna layer 146, a second antenna layer 148, and a third antenna layer 150, each of which includes multiple metamaterial structures 140. In an exemplary embodiment, a portion 152 of the antenna layers 120 has a portion 154 of the ground plane 124 positioned between the three antenna layers 120 and a portion 156 of the manifold/feed layer 126. The portion 152 further includes a substrate 158 (e.g., non-conducting substance, dielectric, insulator, or combinations thereof) inhibiting electrical connection between the ground plane 124 and the metamaterial structures 140 of the multiple antenna layers 120. It is noted that while FIGS. 5 and 6 depict the antenna layers 120 above both the ground plane 124 and the manifold/feed layer 126, this depiction is not limiting, as the antenna layers 120 function independently of orientation (i.e., radiating element may be attached to top or bottom of vehicle 128).

In some embodiments, the substrate material 158 is FR-4 material having a dielectric constant of from 3.5 to 4.5, and loss tangent (6) of from 0.002 to 0.05 In other embodiments, the substrate material 158 comprises a more advanced (e.g., low dielectric constant and low transmission loss) digital, high-speed material. For example, the substrate material 158 may include an epoxy-based material having a dielectric constant of about 3.7 (at 1 GHz), a dielectric constant of about 3.6 (at 10 GHz), a dissipation factor of about 0.002 (at 1 GHz), and a dissipation factor of about 0.004 (at 10 GHz), where the dielectric constant may be +/−0.01-0.05 and the dissipation factor may be +/−0.001-0.005.

In an exemplary embodiment, the portion 152 is a unit cell (e.g., 188, 192, 196, 208, 210, or 212, described below). In another exemplary embodiment, the portion 152 is a two or more dimensional radiating element of the Rx array 116. In another exemplary embodiment, the portion 152 is a two or more dimensional radiating element of the Tx array 118.

In an exemplary embodiment, the radiating element 152 uses slot-aperture coupling enabled by the slot-aperture 134 and the signal via 142 to electrically couple and direct electrical energy from the portion 154 of the ground plane layer 124 to the multiple antenna layers 120 of the radiating element 152. In an exemplary embodiment, the portion 154 positionally coincides with (e.g., encompasses an area above or below) the radiating element 152. In an exemplary embodiment, the slot-aperture 134 receives energy via an AC connection between the slot-aperture 134 and the DC connected signal via 142.

In an exemplary embodiment, the radiating element 152 may comprise a radiating element with an FBW from 3% to 50%. In an exemplary embodiment, the radiating element 152 is approximately 0.05λ to 0.15λ thick, as measured along the z-axis and with respect to the highest operating frequency (e.g., 14.5 GHz). For example, the radiating element 152 may be a three dimensional radiating element with less than, or equal to, 0.05λ spacing at 14.5 GHz between its unit cells (e.g., z-axis, vertical spacing) and 0.5λ between the unit cells of an adjacent (e.g., x-axis or y-axis, horizontal spacing) radiating element.

In an exemplary embodiment, the radiating element 152 may have a scan performance of less than −10 dB return loss out of 60° half conical scan angle for arbitrary phi angle (e.g., between 0° and 360°). In some embodiments, the radiating element 152 may be configured to operate in a frequency range of 10.7 to 14.5 GHz with scan volume from 0° to 60° over all phi angles. In other embodiments, the radiating element 152 may be configured to operate in a frequency range of 26.5 to 40 GHz with scan volume from 0° to 60° over all phi angles.

In another exemplary embodiment, the radiating element 152 may have a required FBW of approximately 18% as a radiating element of the receive array 116, and a required FBW of 3.5%, or less, as a radiating element of the transmit array 118. It is noted that although the required bandwidths are given for exemplary embodiments, the ESA 100 is capable of much more bandwidth than the required FBWs. For instance, the receive array 116 of the ESA 100 may be capable of between 15% and 50% FBW, where the f_low is 10.7 GHz and the f_high is 12.7 GHz, and the transmit array 118 may be capable of between 3% and 5.5%, where the f_low is 14 GHz and f_high is 14.5 GHz.

In an exemplary embodiment, the radiating element 152 may be driven by a steady-state alternating current (AC) signal to obtain one or more impedances for impedance matching of transmitter to transmission line and transmission line to antenna. In an exemplary embodiment, the radiating element 152 is AC driven by a stripline feed (e.g., 170 and/or 172, described below).

Figure 7A:
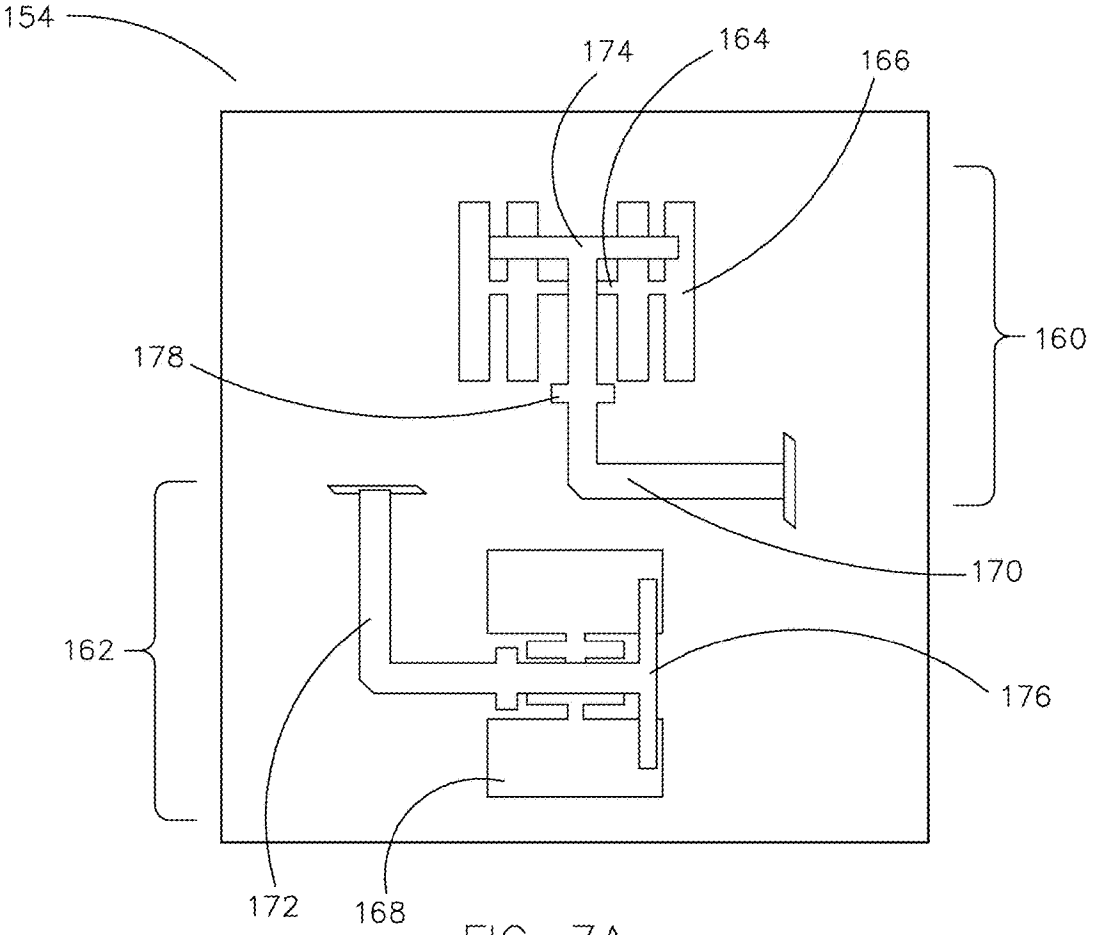
FIGS. 7A-7C are partial top plan views illustrating a ground plane having a stripline feed and two slot apertures, according to the inventive concepts disclosed herein.

Referring now to FIG. 7A, the portion 154 of the ground plane 124 may include multiple ports. For example, the portion 154 may include a port 160 and a port 162. In an exemplary embodiment, the multiple antenna layers 120 become active as a port (e.g., 160 and/or 162) receives an applied voltage (e.g., from stripline feed) at the ground plane 124, which induces an E-field distribution within the slot-aperture 134 and induces currents around the perimeter of the slot-aperture 134, contributing to radiation. In an exemplary embodiment, the ports 160 and/or 162 are substantially centrally located in the portion 154 in order to maximize an amount of substrate 158 surrounding a respective port, and to maximize isolation between co-located ports (e.g., 160 and 162).

In an exemplary embodiment, the slot 134 (see, for example, FIG. 6) may include multiple slot-apertures, each of which may have a specific shape for obtaining polarization synthesis. For example, slot 134 may have a main slot aperture 164 and an orthogonal slot aperture 166, arranged to give the slot 134 a specific "H" shape. In some embodiments, the "H" shape may be repeated symmetrically, such that the slot 134 includes two or more "H" shapes. In other embodiments, only a single orthogonal slot aperture 166 is repeated and connected to the main slot aperture 164, which may result in different specific shapes, including but not limited to, a connected-triline shape (e.g., "III-III"). In an exemplary embodiment, the slot apertures of the slot 134 may have different dimensions with respect to one another. For example, the orthogonal slot aperture 168 may have a larger width than the orthogonal slot aperture 166.

In an exemplary embodiment, different ports (e.g., 160 and/or 162) may be active and/or inactive at a given time to effect different polarizations. In another exemplary embodiment, all of the ports (e.g., 160 and 162) may be active at the same time to achieve a desired polarization. In some embodiments, the shape of the slot 134 and the number of active ports may depend on a type of polarization desired (e.g., LHC, RHC, or dual linear). For example, for dual linear polarization the port 160 and the port 162 may both be active, with the slot apertures of the first port 160 substantially orthogonal to the slot apertures of the second port 162. For instance, the main slot aperture 162 may be substantially orthogonal to the main slot aperture of second port 162, and orthogonal slot aperture 166 may be substantially orthogonal to the orthogonal slot aperture 168 of the second port 162. It is noted that the term "substantially" as it is used in reference to the orthogonal nature of the slot apertures will be determined by the precision of the tool (e.g., lithography instrument) used to form the slot apertures.

In an exemplary embodiment the port 162 may be offset from the port 160 to obtain different polarizations. For example, the port 160 may be configured to provide vertical polarization and the port 162 may be offset by 90° to provide horizontal polarization.

In an exemplary embodiment, the portion 154 of the ground plane 124 may further include a stripline feed (e.g., 170 or 172) terminating in a stub (e.g., 174 or 176) for each port in order to fine tune the antenna reactance. In another exemplary embodiment, one or more additional stubs 178 may be added to further match the impedance of the respective array (e.g., Rx array 116 or Tx array 118). Utilizing a stripline feed (e.g., 170 and/or 172) may be advantageous for reducing or eliminating electromagnetic radiation and back radiation and increasing bandwidth and scan volume.

In another exemplary embodiment, the portion 154 may include both the stripline feed 170 and the stripline feed 172, with feed 172 being 90 (ninety) degrees orthogonal to feed 170.

In an exemplary embodiment, outside the PCB of the circuitry 104, a Lange coupler or a quadrature hybrid coupler may be utilized for feed equalization.

Figure 7B:
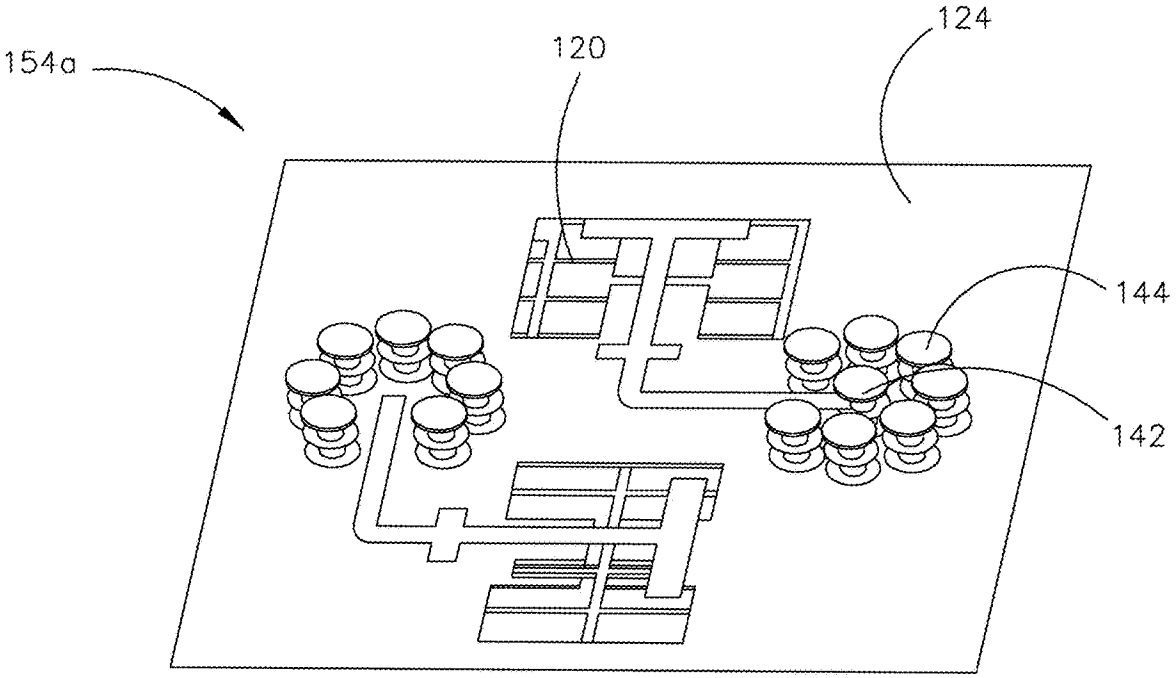

Referring to FIG. 7B, an exemplary embodiment of a portion 154*a* may function similarly to portion 154 except that portion 154*a* may include multiple ground vias 144 forming a concentric ring around a signal via 142. In another exemplary embodiment, each port (e.g., 160 and 162) includes the concentric ring of ground vias 144 around the signal via 142.

Figure 7C:
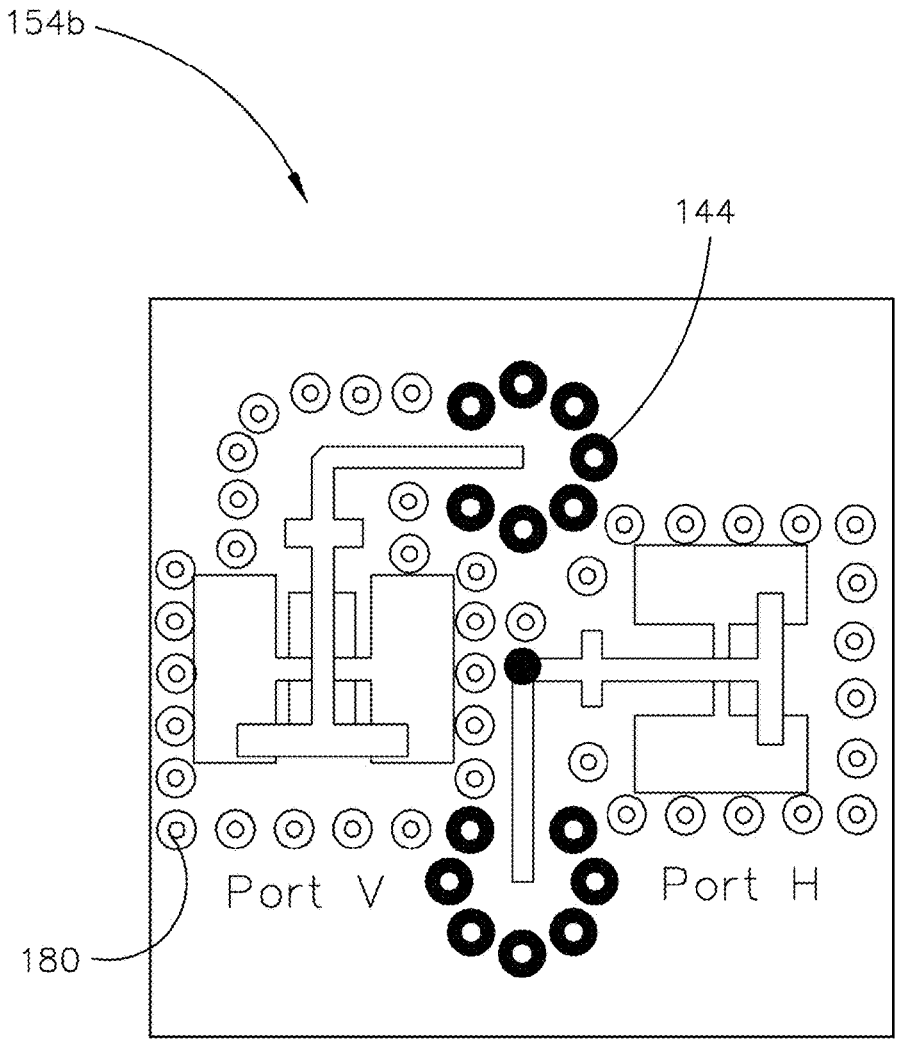
Figure 8A:
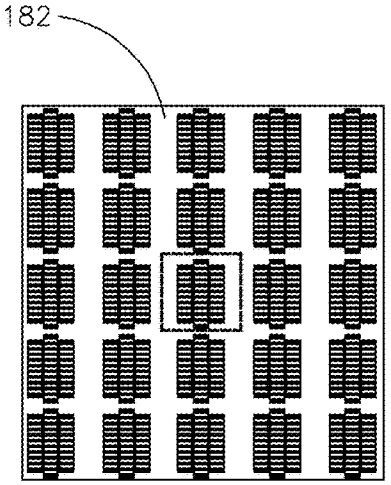
FIGS. 8A-8F show top plan views of antenna layers and unit cells of an embodiment of an antenna receive array, according to the inventive concepts disclosed herein.
Figure 8C:
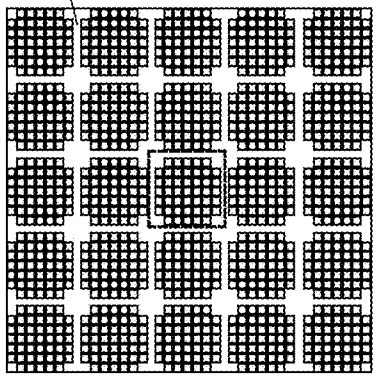
Figure 8E:
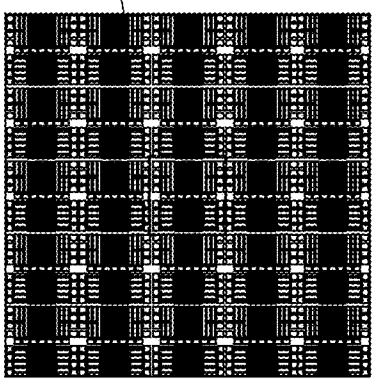
Figure 8B:
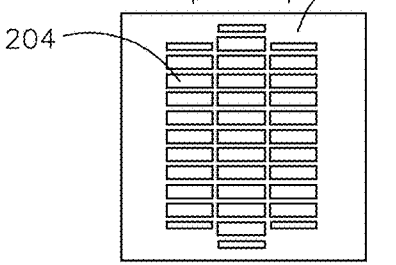
Figure 8D:
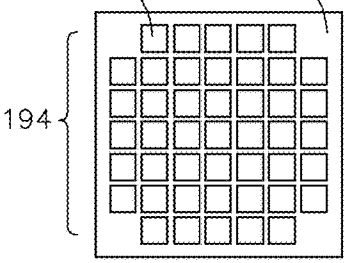
Figure 8F:
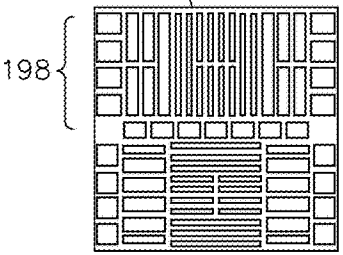
Figure 9A:
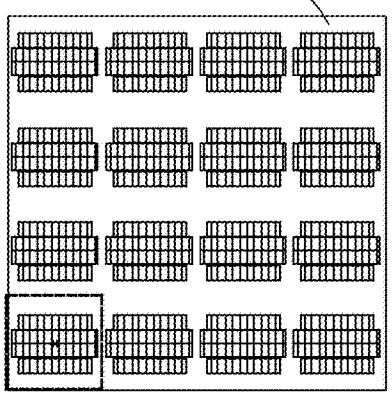
FIGS. 9A-9F show top plan views of antenna layers and unit cells of an embodiment of an antenna transmit array, according to the inventive concepts disclosed herein.
Figure 9B:
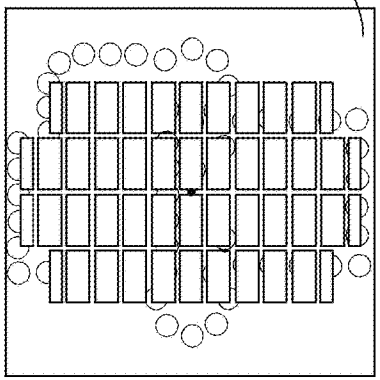
Figure 9C:
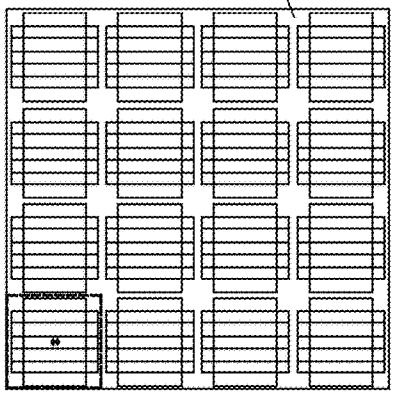
Figure 9D:
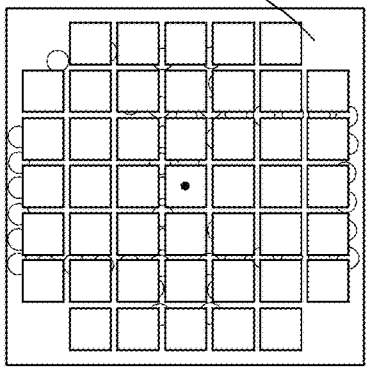
Figure 9E:
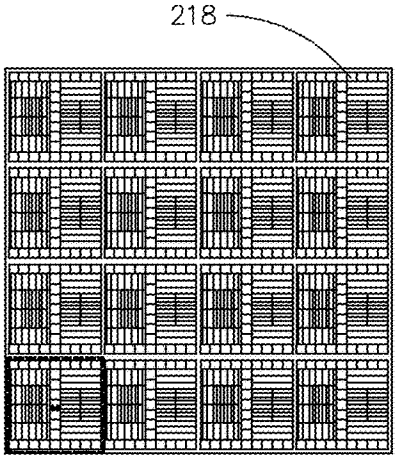
Figure 9F:
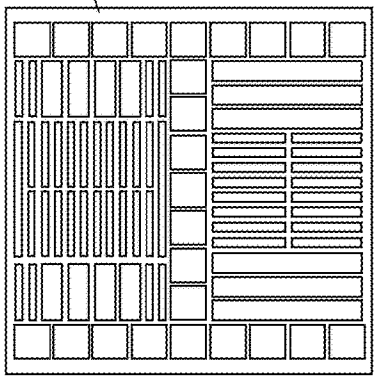

Referring to FIG. 7C, an exemplary embodiment of a portion 154*b* may function similarly to portion 154 and 154*a* except that portion 154*b* may include multiple ground vias 180 (e.g., cylindrical vias) arranged to surround a remaining portion of a respective port (e.g., 160 and/or 162) that is not already encircled about by ground vias 144. Ground vias 180 may function similarly to the ground via 144, except that they may vary in number and size. In another exemplary embodiment, the ground vias 180 are of identical shape and size to ground vias 144. In another exemplary embodiment, the apertures 128*a* are of variable shapes and/or sizes. For example, the ground vias 180 may include cylindrically shaped 10 mil vias, while the ground vias 144 may include cylindrically shaped 12 mil vias. It is noted that the shape and/or size of the multiple vias 128*a* is not limiting, except to the extent that they surround one or more ports (e.g., 160 or 162) and must be sized and shaped to fit around and/or between the ports and within the respective portion (e.g., 154*b*) in which they are formed. It is noted that the multiple ground vias 180 may help to maximize isolation between co-located ports (e.g., 160 and 162) of the radiating element 152.

Referring now to FIGS. 8A-8F, the antenna receive array 116 may include two or more antenna layers. In an exemplary embodiment, the receive array 116 may include three antenna layers with the first antenna layer 182 directly above, below, or to the side of the second antenna layer 184, and the second antenna layer 184 directly above, below, or to the side of the third antenna layer 186. It is noted that the arrangement of the first antenna layer 182 with respect to the third antenna layer 186 will depend on where the antenna system 100 is attached to the vehicle 128 (e.g., top, bottom, side of vehicle 128).

In an exemplary embodiment, when the first antenna layer 182 is below the third antenna layer 186, an amount of metamaterial ascendingly increases over each antenna layer of the receive array 104. For example, the first antenna layer 182 may include a unit cell 188 with a group of structures 190, filling approximately two-thirds of the total area of the unit cell 188. The second antenna layer 184 may include a unit cell 192, with a group of structures 194, filling approximately four-fifths of the total area of the unit cell 192. The third antenna layer 186 may include a unit cell 196, with two or more groups (e.g., 198, 200, and 202) of metamaterial structures, filling just less than the entire area of the unit cell 196.

In an exemplary embodiment, each antenna layer of the receive array 116 has a unit cell with a different configuration of metamaterial structures than a unit cell in another layer in order to obtain desired isolation and impedance matching between vertically adjacent unit cells and free space. For example, the group of structures 190 in the unit cell 188 may comprise three columns or rows of centrally located dipoles, with each dipole 204 of a column/row arranged parallel to the dipoles of another column/row, and with symmetry in at least one direction. In contrast to the arrangement of unit cell 188, the group of structures 194 may comprise multiple rows and/or columns of HOF scattering members 206 centrally arranged within the unit cell 192, with symmetry in at least two directions (e.g., or radially around the plane of the unit cell 180). By way of another example, the unit cell 196 may have two or more sections 198, 200, and 202 with a mixture of HOF scattering members and dipoles within at least two of the sections (e.g., 198 and 200). In an exemplary embodiment, the dipoles of a section 198 may be arranged orthogonally to the dipoles of another section 200 and may be separated by a third section 202 (e.g., a column of HOF scattering structures). In some embodiments, the third antenna layer 186 may act as a type of polarization filter.

In an exemplary embodiment, the unit cells (e.g., 188, 192, or 196) of each layer (e.g., 182, 184, or 186) may be shaped (e.g., rectangular or square) to be tiled in multiple directions with approximately equal spacing between each unit cell and another unit cell. For example, the unit cell 188 may be rectangular-shaped to be tiled left and right, horizontally, with approximately equal spacing between tiled unit cells. In an exemplary embodiment, the approximate equal spacing between tiled unit cells may include one of 0.1λ, 0.25λ, and 0.5λ spacing. In an exemplary embodiment, the spacing is chosen to improve isolation between active radiating elements.

Referring to FIGS. 9A-9F, the unit cells (e.g., 208, 210, and 212) of each layer (e.g., 214, 216, and 218) of the antenna Tx array 118 may function similarly to the unit cells 188, 192, and 196 of the antenna Rx array 116, except that in some embodiments, the metamaterial structures of the third layer 218 of the Tx array 118 may fill more area than the metamaterial structure of the third layer 186 of the Rx array 116. In an exemplary embodiment, spacing between ports (e.g., between a center point of a main aperture 174 and a center point of another main aperture) of radiating element (e.g., 152) of the Tx array 118 is approximately 216 mil. It is noted that the particular spacing between ports of the Tx array 118, or the Rx array 116, is not limiting, as it will depend on the particularities of a respective design.

Figure 10A:
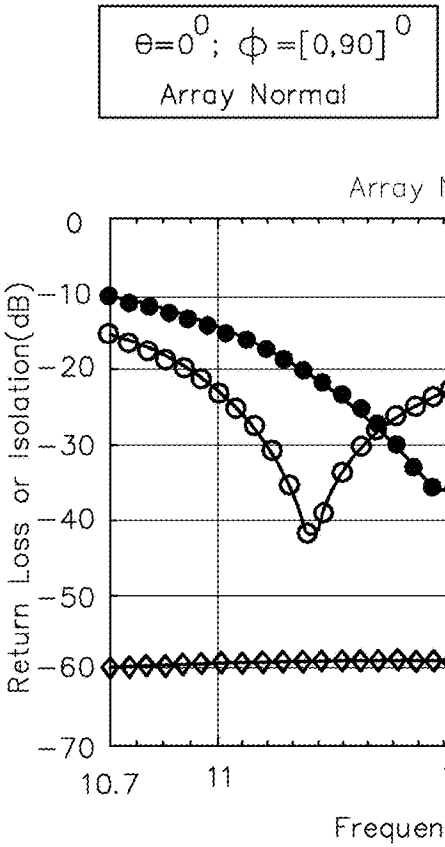
FIGS. 10A-10B show graphical representations of the performance of an embodiment of a receive array radiating element, according to the inventive concepts disclosed herein.
Figure 10B:
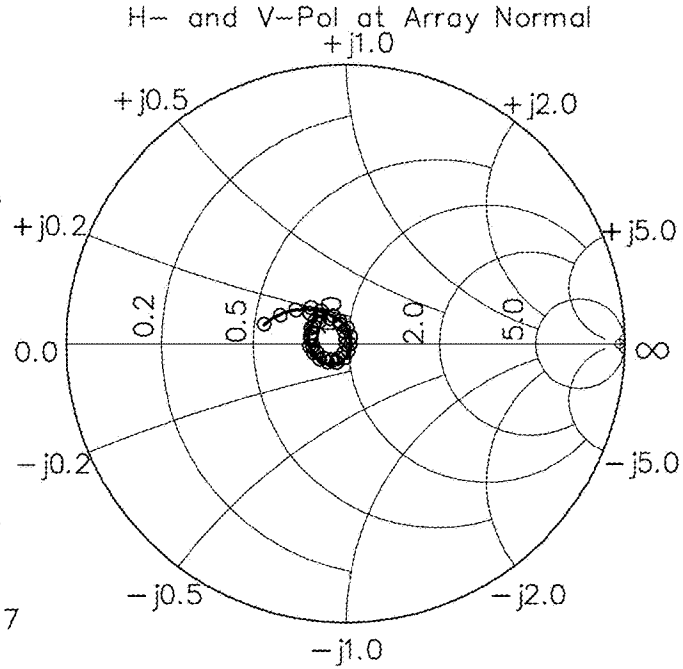

Referring to FIGS. 10A-10B, in at least one exemplary embodiment of the present invention, the performance of a radiating element 152 (e.g., from an antenna layer in the x-y plane) for the Rx array 116 measured at θ (theta, measured off the z-axis, radiating in +z direction) of 0 (zero) degrees and φ (phi, measured counterclockwise from the x-axis) of 0 (zero) or 90 (ninety) degrees is shown in a frequency range of 10.7 to 12.7 GHz. Performance is measured as return loss in decibels and S-parameters. For example, for a steady-state AC signal, the impedance of radiating element 152 supplied by the portion 154 of the ground plane may be expressed as R (for voltage applied across a resistor), sL (for voltage applied to an inductor) and 1/sC (for voltage applied to a capacitor), where s=jω, and ω represents frequency. Return loss is shown in FIG. 10A for a horizontal polarization 1000 and a vertical polarization 1002. Isolation 1004 is shown in decibels in FIG. 10A as isolation between two co-located ports (e.g., 160 and 162) for scan antenna impedance. Performance is measured as impedance in FIGS. 10A and 10B, with each port of the array 116 (e.g., S11 to SNM) having been active when both impedance and isolation were measured.

Figure 11B:
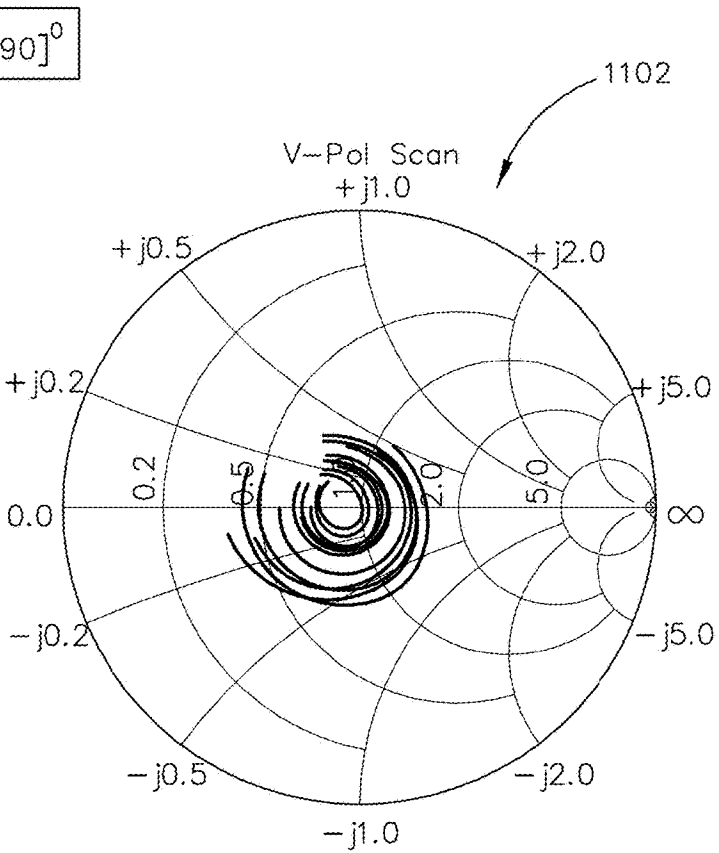
FIGS. 11A-11B show graphical representations of the performance of an embodiment of a receive array radiating element, according to the inventive concepts disclosed herein.
Figure 11A:
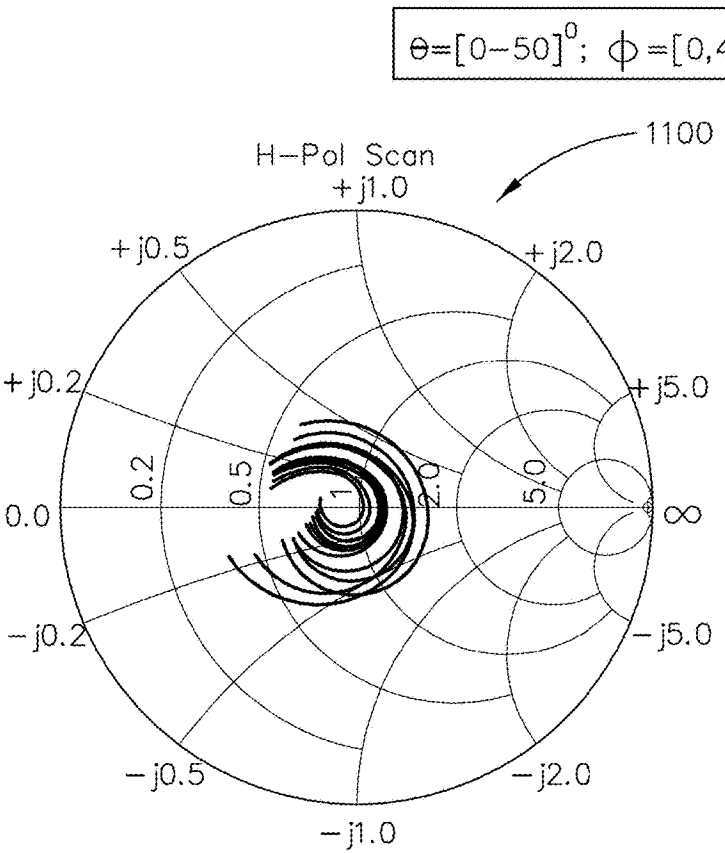

Referring to FIGS. 11A-11B, in at least one exemplary embodiment of the present invention, the performance of a radiating element 152 for the Rx array 116 measured at θ (theta) of 0 (zero) or 50 (fifty) degrees and φ (phi) of 0 (zero), 45 (forty-five), or 90 (ninety) degrees is shown in a frequency range of 10.7 to 12.7 GHz. Performance is measured as impedance in S-parameters for a horizontal polarization scan 1100 and a vertical polarization scan 1102, with all ports being active.

Figure 12B:
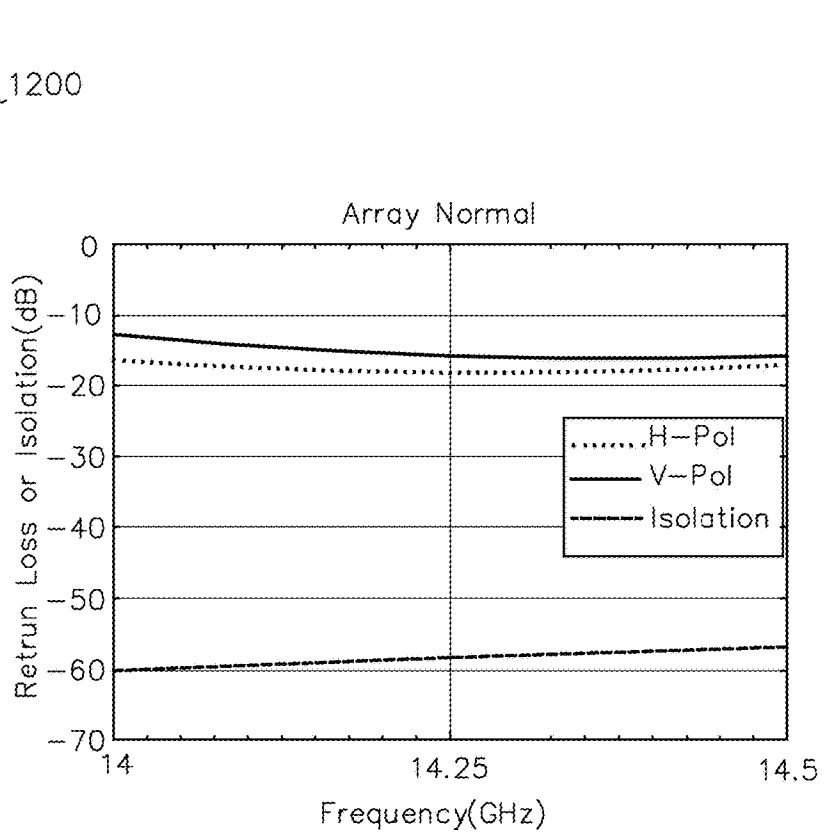
FIGS. 12A-12B show graphical representations of the performance of an embodiment of a radiating element of a transmit array, according to the inventive concepts disclosed herein.
Figure 12A:
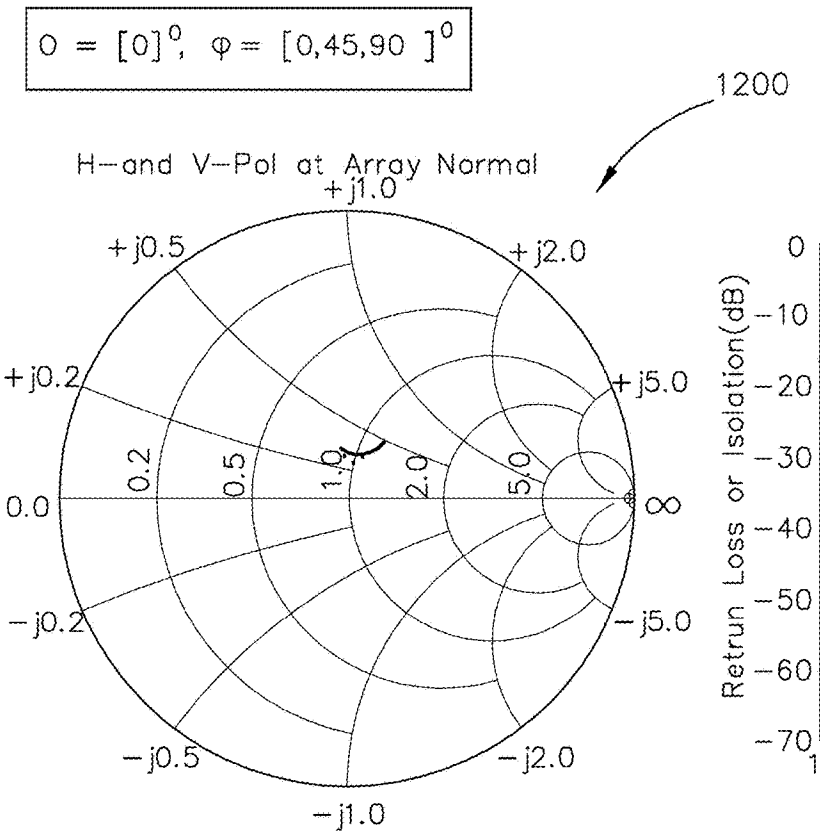

Referring to FIGS. 12A-12B, in at least one exemplary embodiment of the present invention, the performance of a radiating element 152 for the Tx array 118 measured at θ (theta) of 0 (zero) degrees, and φ (phi) of 0 (zero), 45 (forty-five), or 90 (ninety) degrees is shown in a frequency range of 14.0 to 14.5 GHz. Performance is measured as return loss in decibels and S-parameters. Return loss is shown for a horizontal polarization 1202 and a vertical polarization 1204. Isolation 1206 is shown in decibels in FIG. 12B with each port of the array 118 (e.g., S11 to SNM, in S-parameters) having been active when measured. Performance is measured as impedance 1200 in FIG. 12A for horizontal and vertical scans at the array normal. It is noted that measurements were taken with each port of the array 118 (e.g., S11 to SNM) having been active when both impedance and isolation were measured.

Figure 13B:
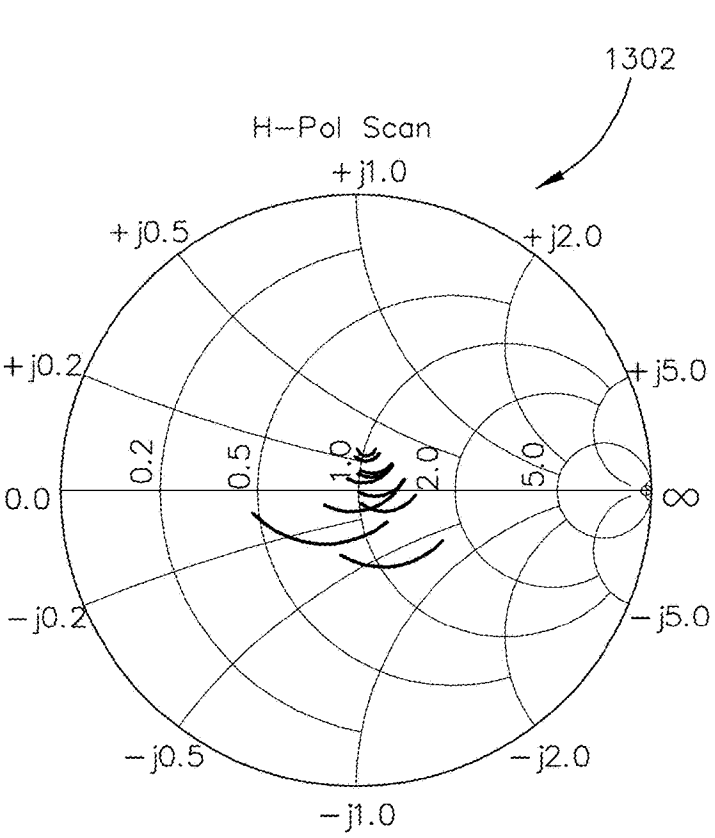
FIGS. 13A-13B show graphical representations of the performance of an embodiment of a radiating element of a transmit array, according to the inventive concepts disclosed herein.
Figure 13A:
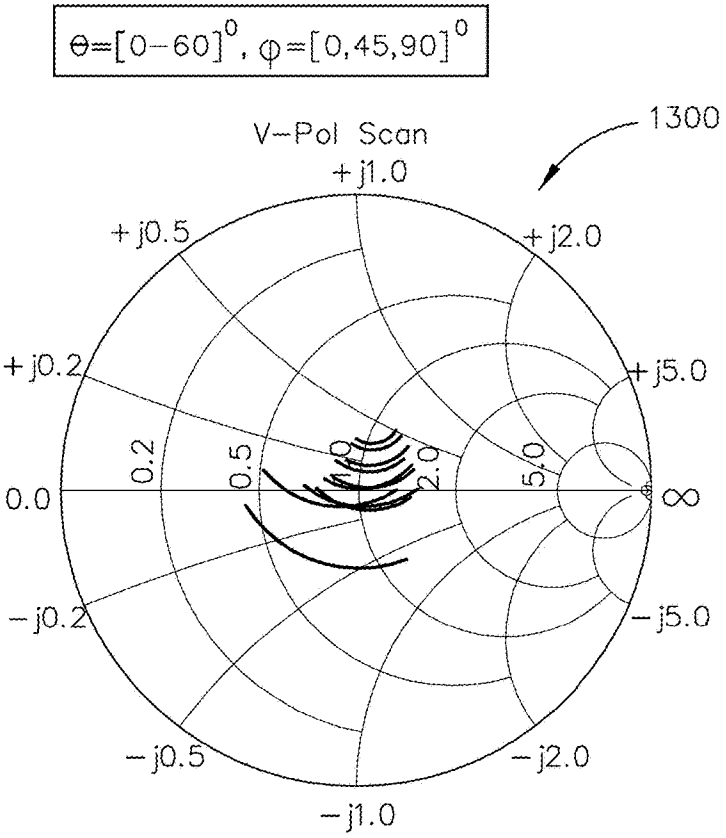

Referring to FIGS. 13A-13B, in at least one exemplary embodiment of the present invention, the performance of a radiating element 152 for the Tx array 118 measured at θ (theta) of 0 (zero) or 60 (sixty) degrees, and φ (phi) of 0 (zero), 45 (forty-five), or 90 (ninety) degrees is shown in a frequency range of 14.0 to 14.5 GHz. Performance is measured as return loss in S-parameters. Return loss is shown for a vertical polarization scan 1300 and a horizontal polarization scan 1302.

It is noted that although some embodiments may depict one or more specific types of slot-aperture coupling, the inventive concepts disclosed herein will be recognized by those skilled in the art to be applicable to different types of directional couplers, different types of power dividers, and/or different types of antennas. Each of which are encompassed by the inventive concepts disclosed herein.

It is to be understood that embodiments of the methods according to the inventive concepts disclosed herein may include one or more of the steps described herein. Further, such steps may be carried out in any desired order and two or more of the steps may be carried out simultaneously with one another. Two or more of the steps disclosed herein may be combined in a single step, and in some embodiments, one or more of the steps may be carried out as two or more sub-steps. Further, other steps or sub-steps may be carried in addition to, or as substitutes to one or more of the steps disclosed herein.

From the above description, it is clear that the inventive concepts disclosed herein are well adapted to carry out the objects and to attain the advantages mentioned herein as well as those inherent in the inventive concepts disclosed herein. While presently preferred embodiments of the inventive concepts disclosed herein have been described for purposes of this disclosure, it will be understood that numerous changes may be made which will readily suggest themselves to those skilled in the art and which are accomplished within the broad scope and coverage of the inventive concepts disclosed and claimed herein.

What is claimed:

1. An electrically scanned array (ESA) system, comprising:

a two or more dimensional radiating element having unit cells tileable in two or more dimensions, and comprising a plurality of metamaterial structures; and a ground plane having two or more ports configured for slot-aperture coupling to electrically couple a stripline feed and a radio frequency (RF) source with the two or more dimensional radiating elements.

2. The system of claim 1, wherein the two or more ports of are centrally located within each radiating element.

3. The system of claim 1, further comprising a plurality of vias sized and shaped to fit around the two or more ports.

4. The system of claim 3, wherein the plurality of vias comprise a first type of via and a second type of via, and wherein the first type of via differs from the second type of via at least with respect to size.

5. The system of claim 1, wherein the plurality of radiating elements comprises a plurality of configurations of the metamaterial structures, each antenna layer having a different configuration of the plurality of configurations.

6. The system of claim 5, wherein the plurality of configurations ascendingly increase in an amount of metamaterial found in a respective configuration beginning with an antenna layer closest to the ground plane and ending with a top antenna layer.

7. An antenna, comprising:

an array of radiating elements comprising a plurality of metamaterial structures formed in a substrate material, at least one radiating element being a two or more dimensional radiating element having unit cells tileable in two or more dimensions; and a ground plane having one or more slot-apertures formed therein, the one or more slot-apertures comprising a plurality of ports, the plurality of ports comprising a first port with a first polarization and a second port with a second polarization, electromagnetic energy radiated from a stripline feed coupling the one or more slot-apertures with the array of radiating elements.

8. The antenna of claim 7, wherein the one or more slot-apertures comprise a plurality of apertures with a first aperture of the plurality of apertures orthogonal to a second aperture of the plurality of apertures.

9. The antenna of claim 7, wherein the one or more slot-apertures have an alternating current (AC) connection between the ground plane and a radiating element of the array, and the stripline feed has a direct current (DC) connection between a radio frequency (RF) source and a signal via.

10. An electronically scanned array (ESA) radiating element, comprising:

a radio frequency (RF) source;

a stripline feed;

a ground plane layer having a slot-aperture formed therein; and a plurality of metamaterial layers, wherein electromagnetic energy radiating from the stripline feed couples the plurality of metamaterial layers with the RF source, wherein the radiating element comprising unit cells tileable in two or more dimensions.

11. The radiating element of claim 10, wherein the radiating element is rectangular shaped and is configured to operate in one of the Ku and Ka bands.

12. The radiating element of claim 10, wherein the radiating element is configured to operate in a frequency range of 10.7 to 14.5 GHz with scan angle $\theta$ of 60° and over all $\varphi$ scan angles, $0 \leq \varphi \leq 360$ degrees.

13. The radiating element of claim 10, wherein the stripline feed is a first stripline feed, wherein the ground plane layer further comprises a second slot-aperture, and wherein electromagnetic energy radiating from the second stripline feed couples the plurality of metamaterial layers with the RF source.

14. The radiating element of claim 13, wherein the first slot-aperture is configured for vertical polarization and the second slot-aperture is configured for horizontal polarization.

15. The radiating element of claim 10, wherein the plurality of metamaterial layers further comprises a first, second, and third metamaterial layer, and wherein the first metamaterial layer comprises less surface area of metamaterial than the second metamaterial layer and the second metamaterial layer comprises less surface area of metamaterial than the third metamaterial layer.

16. The radiating element of claim 10, wherein a metamaterial layer of the plurality of metamaterial layers comprises one or more metamaterial structures, the one or more metamaterial structures comprising at least one of a dipole structure, a High-Order Floquet (HOF) scattering structure, an electrically-small metamaterial structure, and an electrically-large metamaterial structure.

17. The radiating element of claim 10, wherein the slot-aperture comprises a first aperture and a second aperture, and wherein the first aperture is a main aperture and the second aperture is orthogonal to the main aperture.

18. The radiating element of claim 17, wherein the orthogonal aperture is a first orthogonal aperture, and wherein the slot aperture comprises a second orthogonal aperture.

19. The radiating element of claim 10, wherein the slot-aperture comprises an H-shaped aperture.

* * * * *